US009878880B2

(12) United States Patent
Haapaniemi et al.

(10) Patent No.: US 9,878,880 B2
(45) Date of Patent: Jan. 30, 2018

(54) ELEVATOR CAR

(71) Applicants: Markku Haapaniemi, Helsinki (FI); Simo Mantynen, Hyvinkaa (FI); Mika Alvesalo, Espoo (FI); Matti Rasanen, Hyvinkaa (FI); Markku Haivala, Hyvinkaa (FI)

(72) Inventors: Markku Haapaniemi, Helsinki (FI); Simo Mantynen, Hyvinkaa (FI); Mika Alvesalo, Espoo (FI); Matti Rasanen, Hyvinkaa (FI); Markku Haivala, Hyvinkaa (FI)

(73) Assignee: KONE CORPORATION, Helsinki, Finalnd ( * ) Notice: Subject to any disclaimer, the term of this patent is extended or adjusted under 35 U.S.C. 154(b) by 0 days.

(21) Appl. No.: 15/045,728

(22) Filed: Feb. 17, 2016

(65) Prior Publication Data

US 2016/0159614 A1 Jun. 9, 2016

Related U.S. Application Data

(63) Continuation of application No. PCT/FI2014/050646, filed on Aug. 25, 2014.

(30) Foreign Application Priority Data

Sep. 9, 2013 (FI) ..... 20135906

(51) Int. Cl.
*B66B 11/02* (2006.01)
*B66B 7/06* (2006.01)
(Continued)

(52) U.S. Cl.
CPC ..... *B66B 11/0226* (2013.01); *B66B 7/06* (2013.01); *B66B 7/085* (2013.01); *B66B 11/009* (2013.01)

(58) Field of Classification Search
CPC ..... B66B 11/0226; B66B 11/009; B66B 7/06; B66B 7/085
(Continued)

(56) References Cited

U.S. PATENT DOCUMENTS 2,133,621 A * 10/1938 Klein ..... B66B 11/0253 187/401
3,675,379 A * 7/1972 Lambert ..... E04H 1/1238 52/264
(Continued)

FOREIGN PATENT DOCUMENTS

CN 202245636 U 5/2012
GB 1495610 A 12/1977
(Continued)

OTHER PUBLICATIONS

Finish Search Report for Application No. 20135906 dated May 26, 2014.
(Continued)

*Primary Examiner* — Michael Riegelman
(74) *Attorney, Agent, or Firm* — Harness, Dickey & Pierce, PLC

(57) ABSTRACT

The object of the invention is an elevator car intended for transporting people and freight, in an elevator wherein the elevator car is supported resting on suspension members and arranged movably in an elevator hoistway when moved by a hoisting machine. At least the floor and roof of the elevator car are composed of dimensionally precise modular elements fabricated by casting, extruding and/or pressing into their shapes and dimensions.

20 Claims, 6 Drawing Sheets

Figure 1:
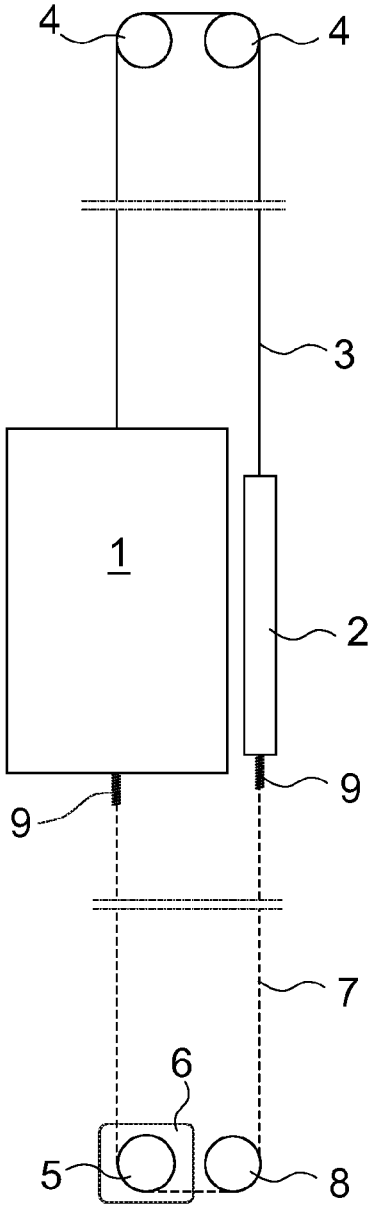

(51) Int. Cl.
*B66B 7/08* (2006.01)
*B66B 11/00* (2006.01)

(58) Field of Classification Search
USPC ..... 187/401
See application file for complete search history.

(56) References Cited

U.S. PATENT DOCUMENTS 4,084,720 A * 4/1978 Thurston ..... B65D 15/22 206/566
4,357,993 A * 11/1982 Halpern ..... B66B 11/0253 187/401
4,635,756 A * 1/1987 Sherwood ..... B66B 11/0253 187/401
4,699,251 A * 10/1987 Orndorff ..... B66B 11/0226 187/401
4,700,809 A * 10/1987 Lazar ..... B66B 11/0253 187/401
4,896,747 A * 1/1990 Inglis ..... B66B 11/0226 187/318
5,454,449 A * 10/1995 Makimattila ..... B66B 11/0253 187/401
5,842,545 A 12/1998 Blaiotta
6,082,501 A * 7/2000 Lehmann ..... B66B 11/0253 187/401
6,209,686 B1 * 4/2001 Tomasetti ..... B66B 11/0226 187/401
6,481,537 B1 * 11/2002 Malone, Jr. ..... B66B 5/0062 187/391
7,882,667 B2 * 2/2011 Smith ..... B05B 15/1214 52/282.1
8,104,587 B2 * 1/2012 Starace ..... B66B 11/0206 187/401
8,210,503 B2 * 7/2012 Garrison ..... E04H 17/16 256/24
2002/0003066 A1 * 1/2002 Zappa ..... B66B 11/0226 187/401
2007/0181383 A1 * 8/2007 Bizarria Santos .. B66B 11/0253 187/401
2011/0100763 A1 * 5/2011 Wiacek ..... B66B 11/0253 187/401
2013/0118841 A1 * 5/2013 Zhang ..... B66B 11/0253 187/401
2014/0305749 A1 * 10/2014 Manner ..... B66B 11/0226 187/401

FOREIGN PATENT DOCUMENTS

JP 2856317 B2 2/1999
JP H11343083 A 12/1999
JP 3305962 B2 7/2002

OTHER PUBLICATIONS

International Search Report PCT/ISA/210 for International Application No. PCT/FI2014/050646 dated Nov. 25, 2014.
Written Opinion of the International Searching Authority PCT/ISA/237 for International Application No. PCT/FI2014/050646 dated Nov. 25, 2014.

* cited by examiner

ELEVATOR CAR

This application is a continuation of PCT International Application No. PCT/FI2014/050646 which has an International filing date of Aug. 25, 2014, and which claims priority to Finnish patent application number 20135906 filed Sep. 9, 2013, the entire contents of both of which are incorporated herein by reference.

The object of the invention is an elevator car as defined in the preamble of claim 1, said elevator car being intended for transporting people and freight.

According to prior art, elevator cars, e.g. to be used in traction sheave elevators, are generally assembled to finished state at the installation site of the elevator, to which site the parts of the elevator car are brought manufactured to different degrees of completion. At first e.g. the floor is assembled, supported by which the walls of the car are fixed, and finally the roof structure is fixed to support car structure thus assembled. The fixings are implemented e.g. with screw fastenings.

The self-supporting elevator car structure according to British patent publication GB1495610 presents one such elevator car structure known in the art. According to the publication, the elevator car comprises a two-part roof structure composed of two side beams bent from steel plate and of steel plate connecting them as well as from a reinforced steel sheet forming the ceiling. Correspondingly, the floor structure is composed of steel plate, which is reinforced underneath with, inter alia, a plurality of profile beams. The roof structure and floor structure are connected to each other with self-supporting panels, which are composed of three different layers in their cross-section, i.e. of an outer layer fabricated from galvanized steel plate, of an inner layer fabricated from plastic-coated steel plate, and also of an insulation layer that forms both fire insulation and sound insulation. Wall panels are fixed with screw fastenings to the roof and floor from inside the car.

A drawback in an elevator car according to the British patent publication presented as well as in other prior-art elevator car solutions of the same type is that this type of elevator car is often awkward to assemble at the installation site and the assembly of the car with all the measuring phases needed takes a lot of time. Among other things, extra time is used because the parts of the elevator car are not always made to precise measurements, in which case fitting them into their correct positions is slow. In addition, the fitting together of these types of slightly imprecise parts might also cause installation errors, which will become apparent in the operation of the elevator e.g. as extra vibration, disturbing noise and even in the breakage of components. Yet another problem is that it is difficult to vary the size and visual appearance of an elevator car according to prior art because elevator cars are generally made for only one visual solution. If it were desired to change the appearance of these types of elevator cars, it would cause an unreasonably large amount of extra work.

Yet another general drawback for the elevator cars of traction sheave elevators according to prior art is that the cars must be made to be sufficiently heavy from the standpoint of traction by friction, even though they could otherwise also be made to be lighter. A lightweight elevator car in conventional traction sheave elevator applications does not enable in all situations sufficient friction between the traction sheave and the elevator rope, in which case the rope can slip on the traction sheave, which results in an undesirable situation. The lightweight elevator car structure according to the invention is well suited, however, to suspension solutions wherein the supporting and the moving of the elevator car are implemented with different members, particularly when the moving of the elevator car is implemented e.g. with a toothed belt or other moving means, which in normal operation does not slip on the traction sheave or corresponding pulley in any situation.

The aim of this invention is to eliminate the aforementioned drawbacks and to achieve a lightweight-structured elevator car that is quick and easy to install, and which can be implemented either as a self-supporting elevator car or as an elevator car to be fixed into connection with a car sling. Another aim is to achieve a lightweight and at least partly modular elevator car solution, the size and appearance of which is easy to vary by using modular parts. The elevator car according to the invention is characterized by what is presented in the characterization part of claim 1. Other embodiments of the invention are characterized by what is presented in the other claims.

Some inventive embodiments are also discussed in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. Likewise the different details presented in connection with each embodiment can also be applied in other embodiments. In addition it can be stated that at least some of the subordinate claims can in at least some situations be deemed to be inventive in their own right.

One preferred solution according to the invention is one in which the elevator car is supported resting on suspension members and arranged to be movable in an elevator hoistway by means of a hoisting machine and at least one traction member, separate from the suspension members, that preferably functions on the shape-locking principle, and in which at least the floor and roof of the elevator car are composed of dimensionally precise modular elements fabricated by casting, extruding and/or pressing into their shapes and dimensions.

The elevator car to be applied in the invention is also applicable to elevators in which the traction members are also suspension members, in other words in elevators in which the elevator car is supported with the traction members. Preferably the traction members are toothed belts, V-belts or other means functioning with a good grip on the driving wheel. Owing to the good grip, the advantages bestowed by the lightness of the elevator car applicable in the invention can be easily obtained in the elevator. A good grip can also be achieved with a so-called double-wrap machine, the traction of the elevator can be implemented using round steel ropes.

The fixing points of the ropings, or corresponding means, needed for supporting and moving the elevator car, and/or the fixing points for diverting pulleys via which the necessary ropings or means are led, can also be easily integrated into the modular structure. For example, in one or more assembly elements of the roof or floor of the elevator car a fixing point for a fixing means or diverting pulley of a suspension member or moving means of the elevator car can be arranged, via which fixing means or diverting pulley this type of suspension member and/or moving means is arranged to travel. Preferably there is local reinforcement at the fixing point.

Fixing points for the controllers and safety devices of the elevator car can also be integrated into the modular structure of the roof and floor of the elevator car. This is particularly so if the elevator car is formed to be self-supporting. In this case, preferably there is local reinforcement at each fixing point for a safety device or controller. Alternatively, the elevator car can be supported in a so-called car sling, in which case the ropings, controllers and many other components are fixed to this car sling. When using a solution with car sling, the elevator car is preferably fixed to the car sling via at least one assembly element of the roof of the elevator car and at least one assembly element of the floor of the elevator car, in which case this type of assembly element has at least one fixing point for fixing the car sling. Preferably there is local reinforcement at the fixing point.

One advantage, among others, of the solution according to the invention is that by means of it an elevator car exactly suited to the purpose is easily enabled, according to both the size and shape of the car as well as according to the weight. Owing to a suspension solution that is suited to the purpose, elevator cars according to the invention can be made to be extremely lightweight, so that also the other structures of the elevator can be reduced in size and weight, in which case also the elevator is inexpensive to manufacture, install and operate. Another advantage is an elevator car that is quickly and easily assembled at the installation site, which can be obtained with great dimensional accuracy owing to its modularity and the fact it is made to precise measurements. Another advantage is also the possibility of using inexpensive tools and machine tools in the fabrication of the parts of the car, particularly when the parts are mainly plastic parts or plastic composite parts.

In the solutions of the invention the joints of a wall and the roof or of a wall and the floor, particularly when the elevator car is self-supporting, are preferably made to be such that a force between the parts travels via a large surface. These types of joints are e.g. crimp bonds and glued joints.

Figure 2:
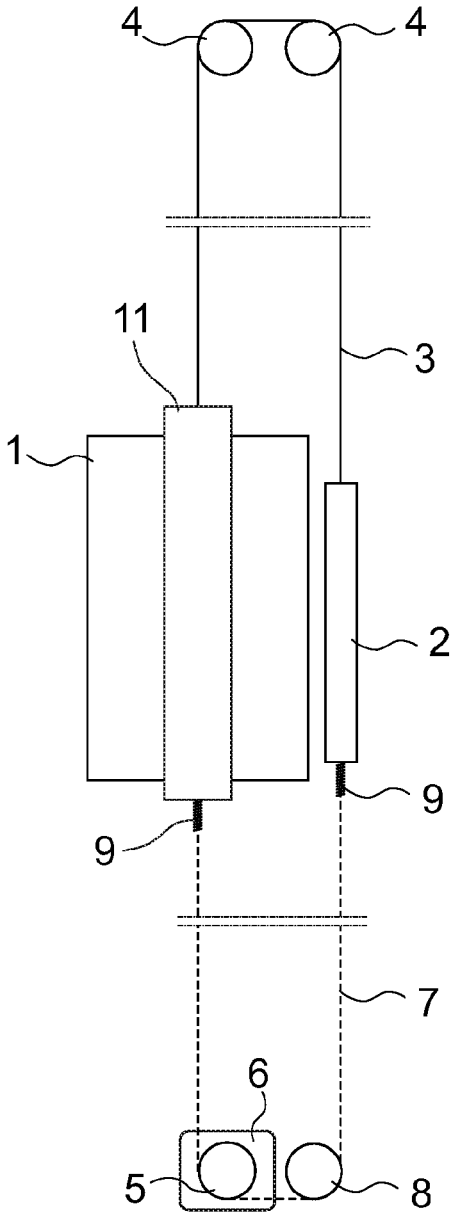
Figure 3:
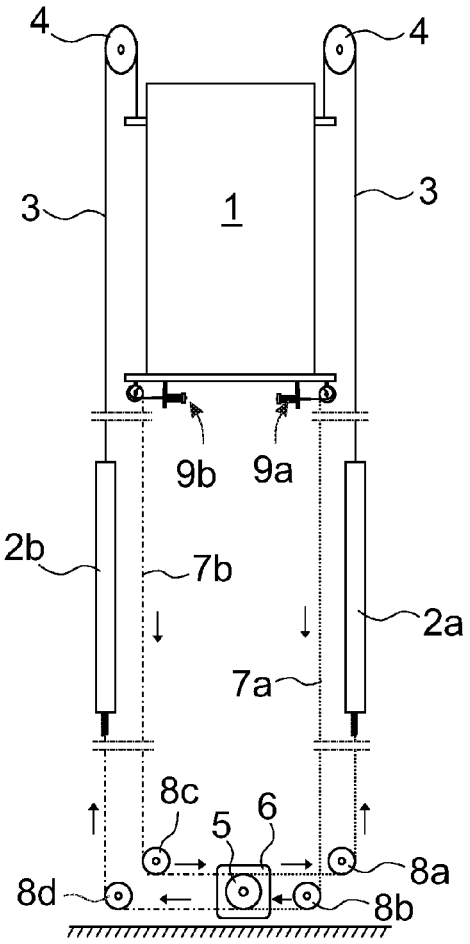
Figure 4:
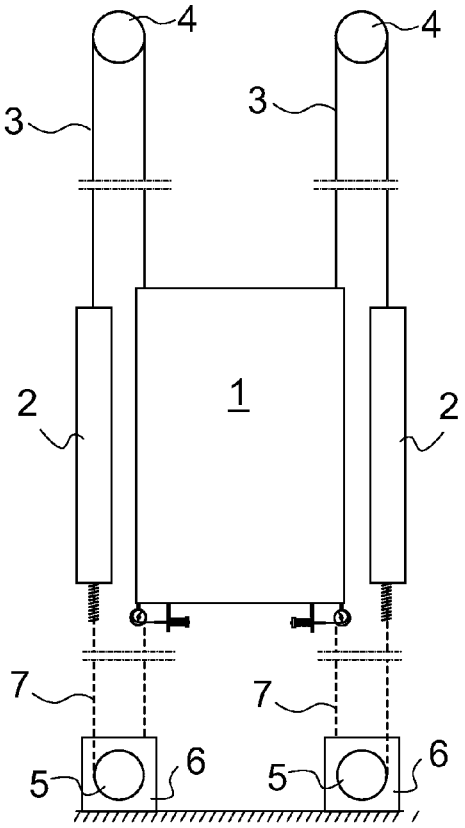
Figure 5:
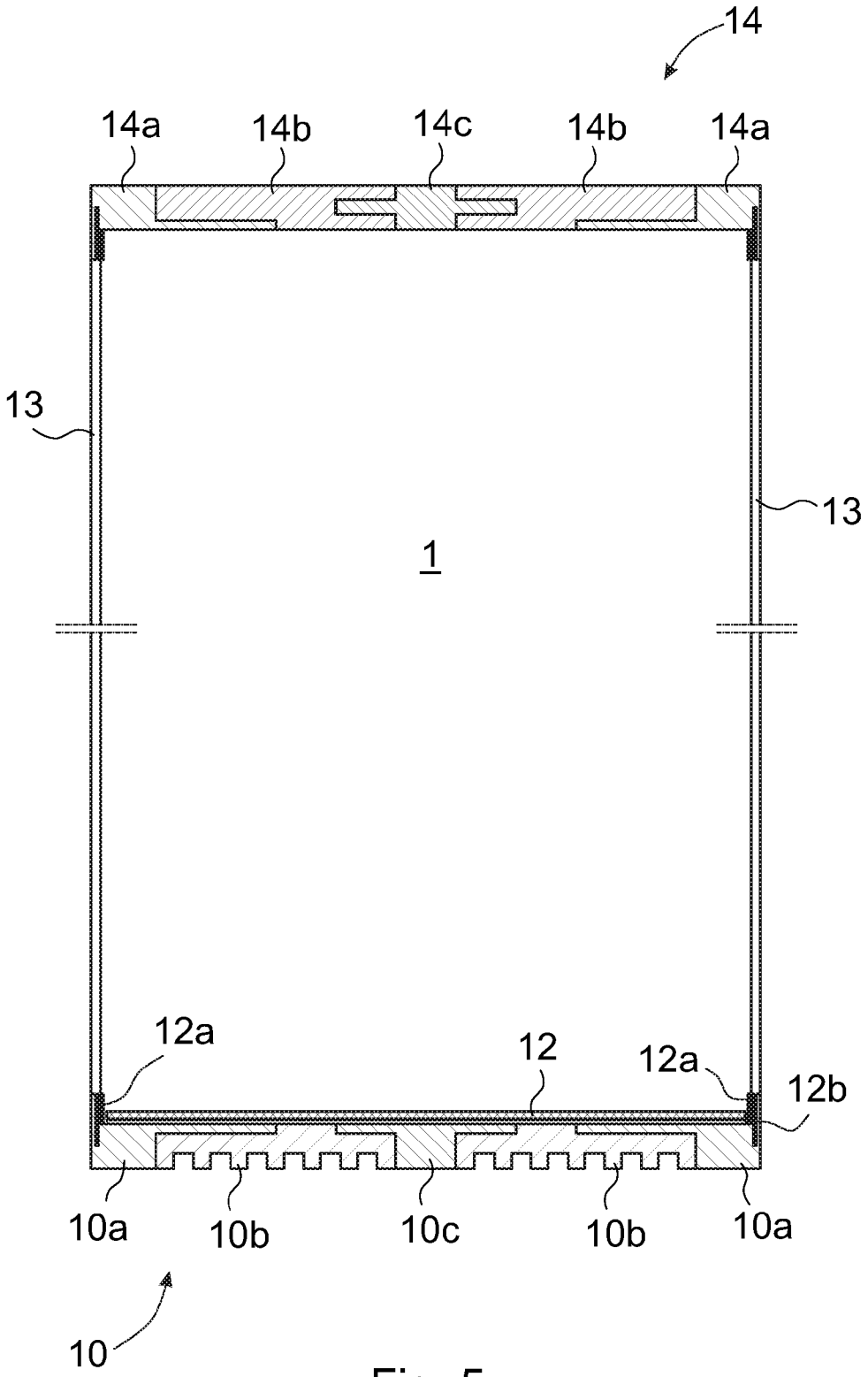
Figure 6:
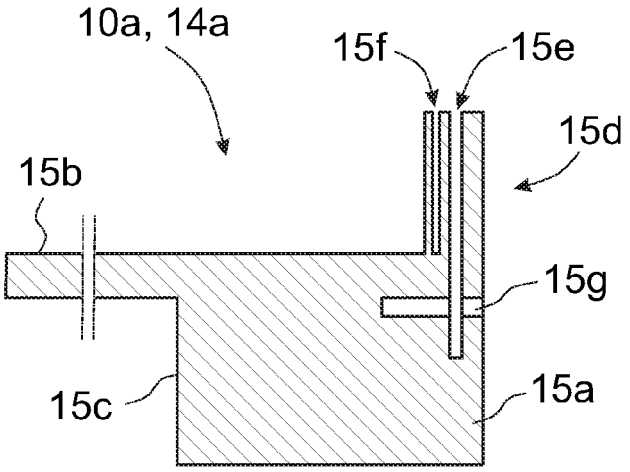
Figure 6A:
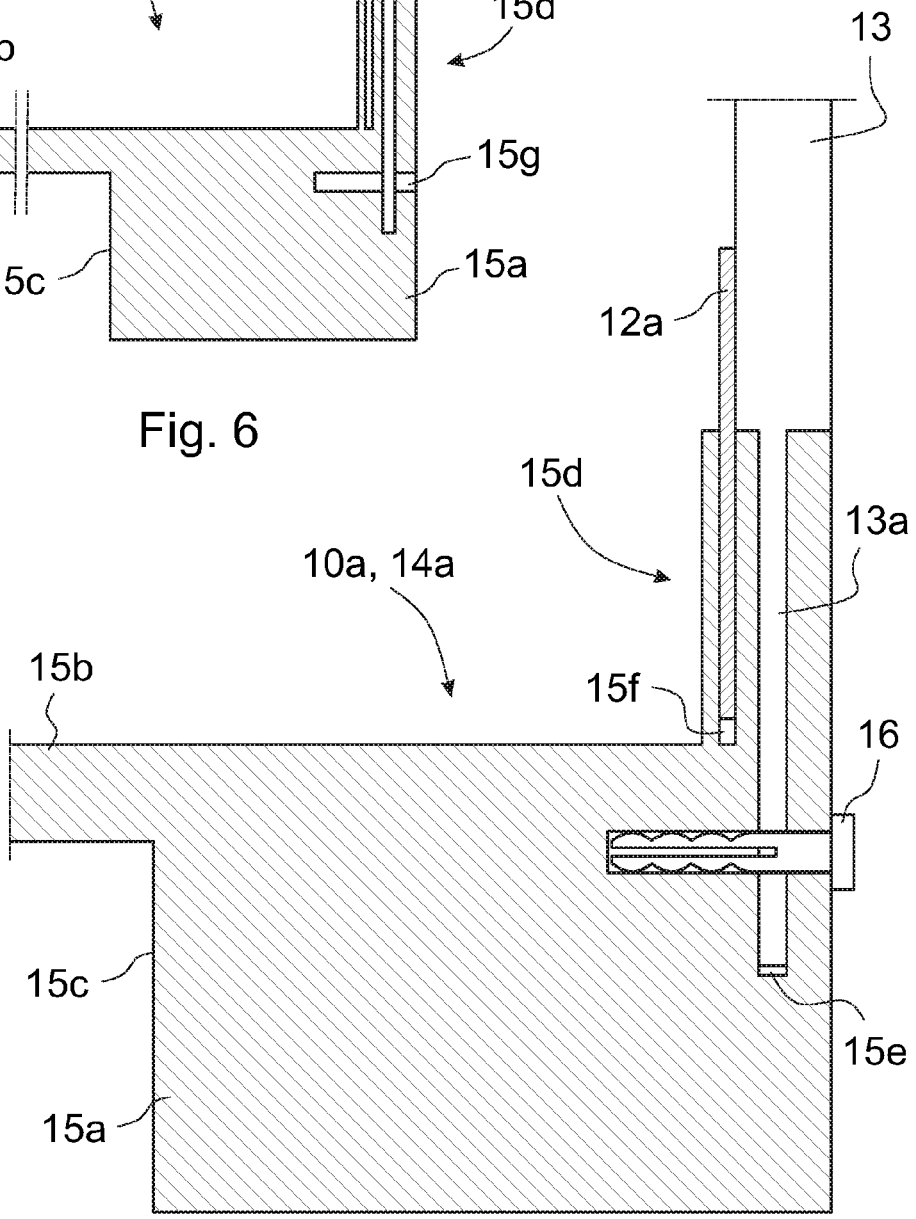
Figure 7:
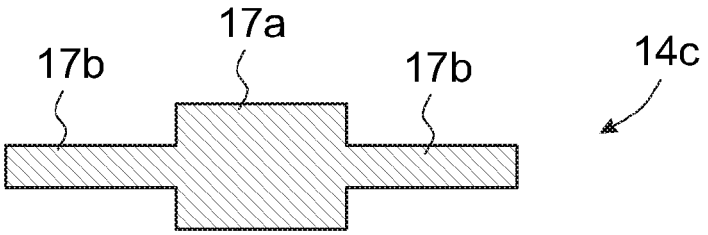
Figure 7A:
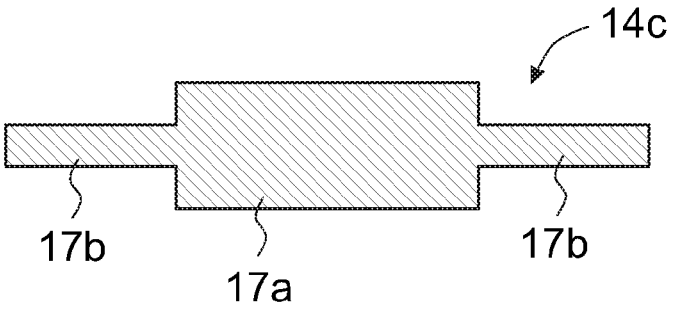
Figure 8:
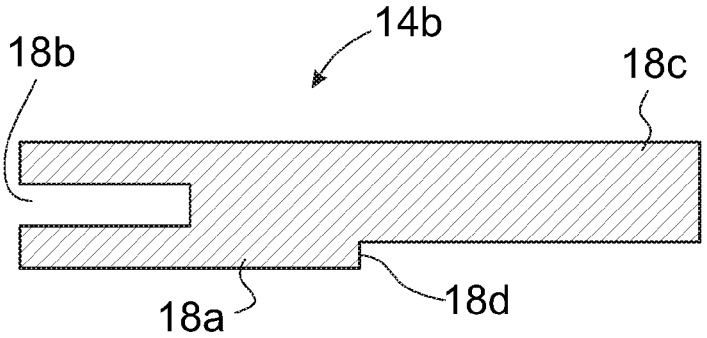
Figure 8A:
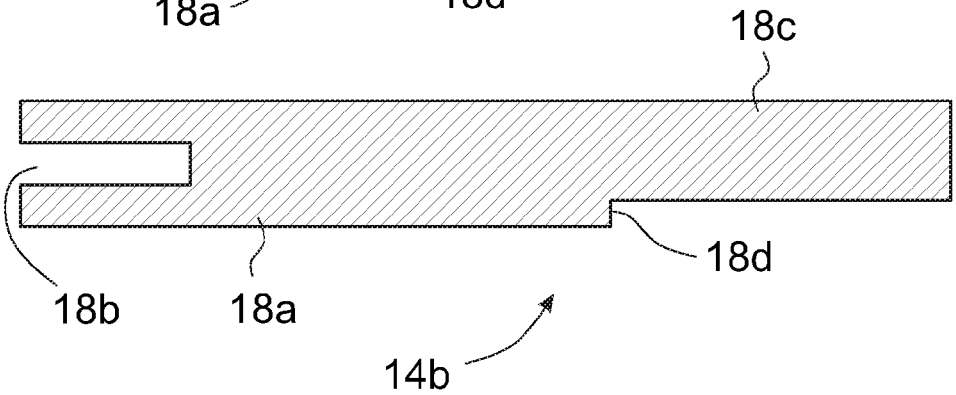
Figure 9:
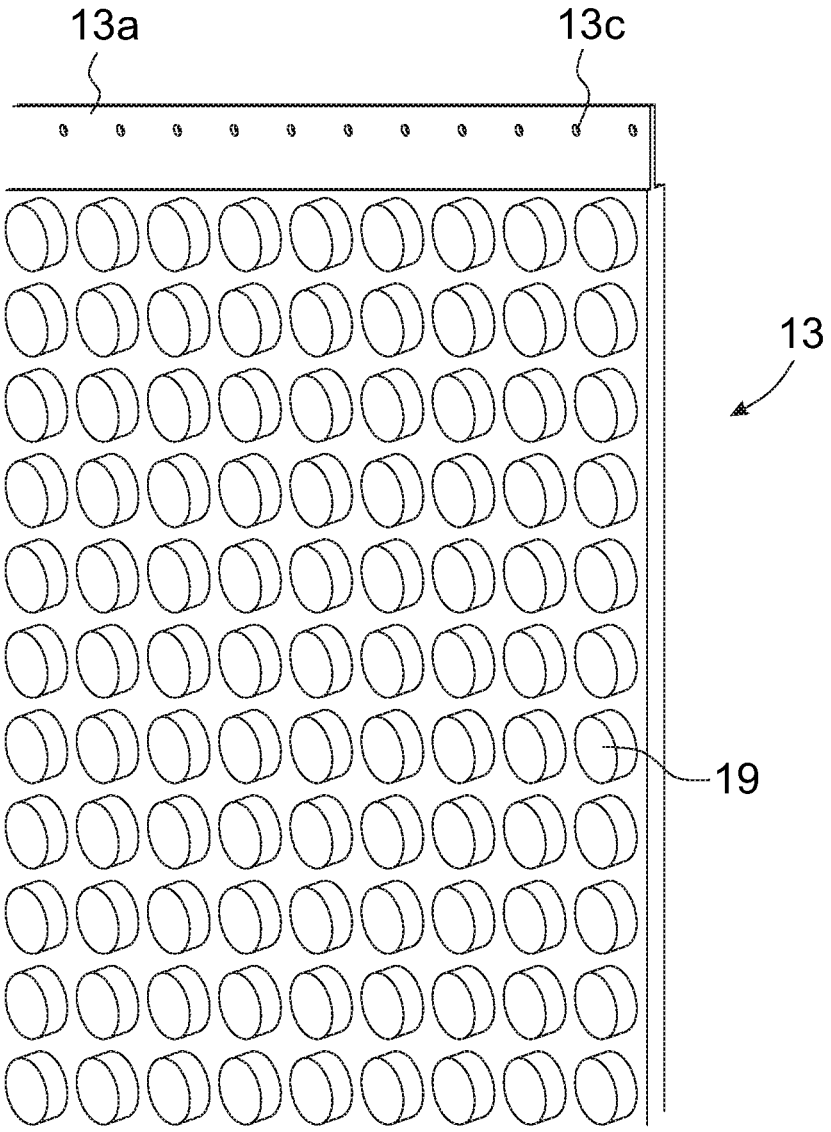

In the following, the invention will be described in more detail by the aid of some examples of its embodiment with reference to the simplified and diagrammatic drawings attached, wherein FIG. 1 presents a simplified and diagrammatic side view of one self-supporting elevator car according to the invention in an elevator in which the moving and the supporting of the elevator car have been separated from each other, FIG. 2 presents a simplified and diagrammatic side view of one elevator car according to the invention, said elevator car being provided with a car sling, in an elevator in which the moving and the supporting of the elevator car have been separated from each other, FIG. 3 presents a simplified and diagrammatic side view of one self-supporting elevator car according to the invention in an elevator suspended in a different manner, wherein the hoisting machine of the elevator is disposed in the bottom part of the elevator hoistway, or close to it, FIG. 4 presents a simplified and diagrammatic side view of one self-supporting elevator car according to the invention, in an elevator wherein two hoisting machines of the elevator are disposed in the bottom part of the elevator hoistway, or close to it, FIG. 5 presents a simplified and diagrammatic sectioned front view of one elevator car according to the invention, FIG. 6 presents a sectioned end view of a partly truncated edgemost modular roof element and/or floor element, according to the invention, for an elevator car, FIG. 6*a* presents a sectioned end view of a magnified detail of a modular roof element and/or floor element according to FIG. 6 as well as of a wall panel fastened into it, FIG. 7 presents a sectioned end view of one modular roof element and/or floor element, according to the invention, for an elevator car, FIG. 7*a* presents a sectioned end view of a modular roof element and/or floor element for an elevator car, said element being wider than the element according to FIG. 7, FIG. 8 presents a sectioned end view of one second modular roof element and/or floor element, according to the invention, for an elevator car, FIG. 8*a* presents a sectioned end view of a modular roof element and/or floor element for an elevator car, said element being wider than the element according to FIG. 8, and FIG. 9 presents a simplified oblique top view of part of a modular wall element, according to the invention, of an elevator car.

FIG. 1 presents a side view of one elevator arrangement wherein, owing to a non-slip moving arrangement, a lightweight and self-supporting elevator car 1 according to the invention can be used. In the elevator arrangement according to FIG. 1 the hoisting machine 6, plus traction sheave 5, is disposed in the bottom part of the elevator hoistway, or close to it. In this case a compensating weight arrangement is used in which the compensating weight 2 is divided into two parts and disposed, symmetrically in the lateral direction, on both sides of the guide rail of the elevator car 1 between the side wall of the self-supporting elevator car 1 and the wall of the hoistway. The frontmost compensating weight 2 in FIG. 1 is in front of the rearmost compensating weight, so the rearmost compensating weight is not visible. A compensating weight 2 divided into parts is suitably small and narrow and it can be disposed in the elevator hoistway easily in the best possible location from the viewpoint of space and layout.

However, only one compensating weight 2 can just as well be used. The use of a compensating weight differs from a counterweight in that a compensating weight saves energy by balancing the mass of the car and the load, whereas the purpose of a counterweight is to achieve sufficient friction between the traction sheave and the elevator ropes.

The supporting rope 3 between the elevator car 1 and the compensating weights 2 is guided to travel from the compensating weights 2 via the diverting pulleys 4 in the top part of the elevator hoistway downwards to the elevator car 1 to as good a location as possible from the viewpoint of the balance of the car and the forces exerted on the guide rails of the elevator car. Correspondingly, the toothed belts or corresponding means that are the traction member 7 are led from the compensating weights 2 via the diverting pulleys 8 in the bottom part of the elevator hoistway to the traction sheave 5 in the bottom part of the elevator hoistway and from there onwards up to the elevator car 1. The traction members are fixed to the elevator car 1 and to the compensating weights 2 e.g. via a fixing means 9 providing a constant tensioning force.

FIG. 2 presents an elevator arrangement that is otherwise similar to that in FIG. 1, but now the elevator car 1 is fitted into a car sling 11 supporting the elevator car 1, which car sling is arranged to bear the load exerted on the elevator car 1. There can be one, two or a number of compensating weights 2.

FIG. 3 presents a simplified and diagrammatic side view of one second elevator arrangement, wherein, owing to a non-slip moving arrangement, a lightweight and self-supporting elevator car 1, or one supported in a car sling, according to the invention can be used. The elevator arrangement according to FIG. 3 comprises two compensating weights 2*a* and 2*b* on different sides of the elevator car 1, both of which compensating weights are connected to the elevator car 1 by the aid of their own suspension members 3. Each suspension member 3 is fixed at its first end to the elevator car 1 and passes over a diverting pulley 4 in the top part of the elevator hoistway or in the machine room and returns downwards, and is fixed at its second end to a compensating weight functioning as a counterweight 2*a*, 2*b*. The fixing point of the first end of the support means 3 to the elevator car 1 is adapted in such a way that the elevator car 1 can rise past the diverting pulleys 4 in the top end of the hoistway right to the top end of the hoistway. In this way the most space-efficient layout solution possible is achieved.

A hoisting machine 6 provided with a traction sheave 5 is adapted to move the elevator car 1, which hoisting machine is preferably disposed in the bottom part of the elevator hoistway, e.g. on the base of the elevator hoistway or right in the proximity of the base. In this case installation of the hoisting machine 6 is easy, and long electric cables from the bottom part of the building to the hoisting machine and to the cubicle are not needed.

For each compensating weight separately its own traction member 7*a*, 7*b* is disposed between the bottom part of the compensating weights 2*a*, 2*b* and the bottom part of the elevator car 1, which traction member receives its movement transmission force from the traction sheave 5 of the hoisting machine 6. The first traction member 7*a* is fixed at its first end to the first compensating weight 2*a*, is adapted to leave the compensating weight 2*a* and go downwards and is led to pass under at least one diverting pulley 8*a*, after which the traction member 7*a* is led to a traction sheave 5, which rotates on the vertical plane, of the hoisting machine 6 disposed below the elevator car 1 from the first side of the traction sheave 5, and is adapted to pass around the traction sheave 5 at the first point of the contact surface of the traction sheave 5 from the second side of the traction sheave 5, to return back to the first side of the traction sheave 5 and is led onwards to pass under at least a second diverting pulley 8*b* and to ascend after this to the elevator car 1, on which is a fixing means 9*a* maintaining essentially constant tensioning force, to which fixing means the traction member 7*a* is fixed at its second end.

The second traction member 7*b* is adapted to travel from the second compensating weight 2*b* via the traction sheave 5 to the elevator car in essentially the same manner as the first traction member 7*a*. In this case the second traction member 7*b* is fixed at its first end to the second compensating weight 2*b*, is adapted to leave the compensating weight 2*b* and go downwards and is led to pass under at least one diverting pulley 8*d*, after which the traction member 7*b* is led to a traction sheave 5, which rotates on the vertical plane, of the hoisting machine 6 disposed below the elevator car 1 from the second side of the traction sheave 5, and is adapted to pass around the traction sheave 5 at the second point of the contact surface of the traction sheave 5 from the first side of the traction sheave 5, to return back to the second side of the traction sheave 5 and is led onwards to pass under at least a second diverting pulley 8*c* and to ascend after this to the elevator car 1, on which is a fixing means 9*a* maintaining essentially constant tensioning force, to which fixing means the traction member 7*b* is fixed at its second end.

The contact surface of the traction sheave 5 is so wide that both the traction members 7*a*, 7*b* fit side-by-side onto the contact surface of the traction sheave without interfering with each other. In this way one and the same hoisting machine 6 gives to both the traction members 7*a*, 7*b* a force producing linear movement of the elevator car 1 and of the compensating weights 2*a*, 2*b*.

FIG. 4 presents a front view of yet another elevator arrangement wherein, owing to a non-slip moving arrangement, a lightweight and self-supporting elevator car 1, or one supported in a car sling, according to the invention can be used. In the elevator arrangement according to FIG. 4 are two hoisting machines 6 of the elevator, which, with the traction sheaves 5, are disposed in the bottom part of the elevator hoistway, or close to it. The first hoisting machine 6 is fitted between one or more compensating weights 2 and the elevator car 1 on one side of the elevator car 1, and the second hoisting machine 6 is fitted between one or more compensating weights 2 and the elevator car 1 on a second side of the elevator car 1. This solution enables the base of the elevator hoistway to be made level, particularly in its center part, and the lifting mechanics can be made simple.

In the arrangements according to FIGS. 1-4, the traction member 7, 7*a*, 7*b* can be either a plurality of parallel hoisting ropes, a chain or a belt, e.g. a toothed belt. What all the arrangements presented have in common is that the traction members 7, 7*a*, 7*b* are fixed at one of their ends, e.g. their ends on the elevator car 1 side, with fixing means 9, 9*a*, 9*b* providing a constant tensioning force in such a way that the traction member 7, 7*a*, 7*b* always remains sufficiently taut on the rim of the traction sheave 5 and that when the support members 3 of the elevator car 1 stretch and loosen, the fixing means 9, 9*a*, 9*b* remove via the traction members 7, 7*a*, 7*b* the elongation produced.

In an elevator arrangement using an elevator car according to the invention, the supporting of the elevator car 1 is preferably separated from the moving means of the elevator car and smart materials, such as toothed belts, in which traction is not based on friction but instead on shape-locking, suited to the purpose are preferably used as the moving means, i.e. as the traction members 7, 7*a*, 7*b*. Since the traction is not based on friction, the elevator car 1 can be made as lightweight as is for other reasons possible.

FIG. 5 presents a simplified, sectioned and diagrammatic front view of a minimized detail of one elevator car 1 according to the invention. The modular elevator car 1 is assembled mainly from dimensionally precise modules, i.e. elements 10*a*-10*c*, 13, 14*a*-14*c*, which are fabricated by casting, extruding or pressing and at the latest in the installation phase cut to their correct dimensions and are also joined and fixed to each other in various ways. Different sorts of plastics, such as polyurethane, polyacrylic, polyethylene, or combinations of these, are used as the raw material of the elements. The elements 10*a*-10*c*, 13, 14*a*-14*c* can also contain various reinforcements and can be partly or wholly plastic composite elements or laminated elements. In addition, the elements 10*a*-10*c*, 13, 14*a*-14*c* can, if necessary, be covered with some suitable coating, such as e.g. with a thin metal sheet. The elements 10*a*-10*c* intended for the floor 10 and the elements 14*a*-14*c* intended for the roof 14 are fabricated e.g. by dimensionally precise extruding from the desired sort of plastic.

In the solution according to FIG. 5 the floor elements and roof elements 10*a*-10*c*, 14*a*-14*c* are, except for the corner elements 10*a*, 14*a*, different to each other, but all the elements can just as well be similar to each other e.g. in such a way that the intermediate elements 10*b*, 14*b* are similar to each other and likewise the center elements 10*c*, 14*c* are correspondingly similar to each other.

In the installation phase each modular floor element and roof element 10*a*-10*c*, 14*a*-14*c* is cut to its correct length e.g. in the depth direction of the elevator car 1. Correspondingly, when adjusting the width of the elevator car 1, pieces of the necessary width are cut away to precise measurement from the long sides of the floor elements and roof elements 10*a*-10*c*, 14*a*-14*c* in such a way that adjacent elements again fit to be connected to each other according to their purpose. Alternatively also standard elements of different widths are used, from which elevator cars of standard dimensions and different widths can be quickly assembled. The use of standard elements of different widths is explained in more detail in connection with FIGS. 7-8*a*.

The frame structure of the floor 10 of the elevator car 1 is composed e.g. of three elements 10*a*-10*c* that are different to each other in their cross-sections, which elements are e.g. two corner elements 10*a*, two intermediate elements 10*b* and one center element 10*c*. As viewed from the front of the elevator car 1, the corner elements 10*a* are situated on opposite edges of the elevator car 1 and face-to-face with respect to each other. To one of the long sides of each corner element 10*a* an intermediate element 10*b* is fixed at its first long side, and between the intermediate elements 10*b* a center element 10*c* essentially symmetrical in its cross-section in the width direction is fitted, which center element 10*c* is fixed at both its long sides to one long side of one intermediate element 10*b*. The elements are fixed to each other with various fixing methods, e.g. by gluing and/or with screw fastenings.

The frame structure of the roof 14 of the elevator car 1 is essentially similar to the frame structure of the floor 10 and is composed of the same type, and even of similar, modular elements 14*a*-14*c* to those of the floor 10 of the elevator car 1. In FIG. 5 the elements 10*b*-10*c* and 14*b*-14*c* are different to each other, but they can therefore also be similar to each other. The roof 14 of the elevator car is assembled on the same principle as the floor 10 and the elements 14*a*-14*c* are fastened to each other in essentially the same manner as the elements 10*a*-10*c* of the floor 10.

In/on the long side edges of the floor elements and roof elements 10*a*-10*c* and 14*a*-14*c* are slots or recesses in the longitudinal direction of the elements and protrusions corresponding to them, which are dimensioned in such a way that the intermediate elements and center elements 10*b*-10*c*, 14*b*-14*c* situated side-by-side between corner elements 10*a*, 14*a* form, together with the corner elements 10*a*, 14*a*, a durable and robust slab-like structure having, e.g. at least on the inside of the elevator car, a uniform and essentially smooth surface.

In addition, in the corner elements 10*a*, 14*a* are slots and fixing holes for the fixing of a wall element 13 and slots for the fixing of a shallow wall skirting 12*a*, which wall skirting simultaneously functions as a skirting board. The aforementioned slots are explained in more detail later in connection with FIGS. 6 and 6*a*.

A fire prevention plate 12*b* is disposed on top of the floor elements 10*a*-10*c*, which simultaneously stiffens the floor structure and consequently increases the load carrying capacity of the floor 10. Correspondingly, the actual floor surface board 12, which forms the wearing surface of the floor 10, is fastened on top of the fire prevention plate 12*b*. The fixing is implemented e.g. by gluing.

The wall elements 13 are fabricated by pressing from molding compound basic plates comprising one module, from which plates wall panels of the size needed are cut in the installation phase, which wall panels are fixed at their bottom part to the corner elements 10*a* of the floor 10 of the elevator car 1 and at their top part to the corner elements 14*a* of the roof 14 of the elevator car 1, e.g. with snap-on fasteners or with a screw fitting. The structure and fixing of the wall elements 13 are presented in more detail in FIGS. 6*a* and 9.

FIGS. 6, 6*a* and 7, 7*a* and also 8, 8*a* present a cross-section of modular roof elements and floor elements according to the invention, when viewed from the end and sectioned. FIGS. 6 and 6*a* present the corner elements 10*a*, 14*a* used in the floor 10 or roof 14 of an elevator car, and FIGS. 7-8*a* present two modular elements of an elevator car 1 as two versions having different widths. The elements presented are the center element 14*c* and intermediate element 14*b* of the roof of the elevator car, but the elements could just as well be the corresponding elements 10*c* and 10*b* of the floor 10 of the elevator car.

In the cross-section of each element 10*a*-10*c* and 14*a*-14*c* in the width direction of each element are parts of different thicknesses and shapes, such as protrusions, slots and recesses, which are consequently formed in such a way that elements placed side-by-side next to each other can be situated in a partly nested or overlapping manner. In this case e.g. the protrusion of an adjacent element is situated in the slot or recess of a second element and the adjacent elements support each other at the point of connection.

The corner element 10*a*, 14*a* presented in FIG. 6 comprises a frame part 15*a* essentially corresponding in its thickness to the largest thickness of the other elements, from which frame part a protrusion 15*b* extends in the lateral direction of the element, the thickness of which protrusion is smaller than the thickness of the frame part 15*a*. The thickness difference between the frame part 15*a* and the protrusion 15*b* is filled by a recess 15*c*, which is intended to receive the corresponding protrusion 15*b* of the intermediate element. In addition, extending from the frame part 15*a* on the outer edge of the frame part is a wall fixing protrusion 15*d*, which is perpendicular to the width direction of the corner element. In the wall fixing protrusion 15*d* is a slot 15*e* the length of the whole element for the fixing of a wall panel 13, a second parallel but narrower slot 15*f* for the fixing of the wall skirting 12*a*, as stated earlier. In addition, in the frame part 15*a* is a plurality of fixing holes 15*g* for a wall panel 13, which fixing holes extend through the mounting slot 15*e* for a wall panel.

FIG. 6*a* presents the outer corner of a corner element 10*a*, 14*a* magnified and sectioned in such a way that the wall panel 13 is fixed into its position in the corner element. On the top edge and bottom edge of a wall panel 13 is a batten-shaped fixing edge 13*a* that is thinner than the rest of the wall panel and is provided with fixing holes 13*c*, which fixing edge is arranged to fit into the slot 15*e* of a corner element 10*a*, 14*a*, and which is fixed into position by means of fixing means 16, such as snap-in fasteners or fixing screws.

The joints of a wall and the roof or of a wall and the floor, particularly if the elevator car is self-supporting, are preferably made to be such that a force between the parts travels via a large surface. For example, the fixing means 16 preferably presses the fixing edge 13*a* between the walls of the mounting slot 15*e*. This type of joint is more secure than if the forces between the fixing edge 13*a* and the mounting slot 15*e* were arranged to travel just as shearing force via the fixing means 16.

FIG. 7 presents a sectioned end view of the center element 14*c*, presented in FIG. 5, of the roof 14 of the elevator car 1, said element comprising a frame part 17*a* essentially corresponding in its thickness to the largest thickness of the other elements in the roof, from which frame part a protrusion 17*b* extends in both lateral directions of the element, the thickness of which protrusion is smaller than the thickness of the frame part 17*a*.

Correspondingly, FIG. 7*a* presents a center element 14*c* of the roof 14, which differs from the center element 14*c* presented by FIG. 7 only in that the frame part 17*a* of the latter is wider than the frame part 17*a* of the center element 14*c* presented by FIG. 7.

FIG. 8 presents a sectioned end view of the intermediate element 14*b*, presented in FIG. 5, of the roof 14 of the elevator car 1, said element comprising a frame part 18*a* essentially corresponding in its thickness to the largest thickness of the other elements in the roof, in the one long edge of which is a slot 18*b* the length of the element, which slot is intended to receive the corresponding protrusion 17*b* of the center element 14*c*, and on the second long edge of which is a protrusion 18*c*. The thickness difference between the frame part 18*a* and the protrusion 18*c* is filled by a recess 18*d*, which is intended to receive the corresponding protrusion 15*b* of the corner element 14*a*.

Correspondingly, FIG. 8*a* presents an intermediate element 14*b* of the roof 14, which differs from the intermediate element 14*b* presented by FIG. 8 only in that the frame part 18*a* of the latter is wider than the frame part 18*a* of the intermediate element 14*b* presented by FIG. 8.

It is advantageous to vary the width of the roof elements 14*b*-14*c*, and correspondingly of the floor elements 10*b*-10*c*, of the elevator car 1 by varying the width of only a part of the element, which part is as thick as the whole element, i.e. the width of the center parts 17*a* and 18*a* in roof elements. The width of the elevator car 1 is easy to adjust with roof elements and floor elements of different widths, in which case just the use of center elements 14*c* of a certain width might be sufficient for certain widths. There can also be more standard widths than the two widths presented in FIGS. 7-8*a*, e.g. 3, 4, 5, 6 pieces, et cetera.

FIG. 9 presents a simplified oblique top view of part of a modular wall panel 13, according to the invention, of an elevator car 1. Sound-damping damping means 19, such as cylindrical or conical nodules protruding from the wall surface, are formed on a fabricated wall panel 13 in the manufacturing phase of the wall panel 13 by extruding, which nodules are situated e.g. on the outer surface of a wall panel 13 to essentially fill most of the outer surface. The nodular or corresponding sound-damping board can also be a separate element that is fixed to a wall panel by means of some suitable fastening means. Perforations, with which possible impact noise resulting e.g. from tapping a wall surface in the elevator car is damped, can be in a part of a wall panel. Preferably also a plurality of cable channels for the electrification of the elevator car is made on the surface of a wall panel 13 in conjunction with the fabrication of the wall panel. The interior wall coating of a wall panel 13 of the elevator car 1 is e.g. laminate, wood veneer, metal, et cetera.

In addition, reinforcements are fixed to the roof structure and floor structure for the door of the elevator car, by means of which reinforcements the door operator and sill can be reliably and securely fixed to the elevator car. Correspondingly, separate fasteners for the front wall on the side of the door of the elevator car are preferably fitted to the wall panels 13 of the elevator car. Likewise, in the elevator car are means for supporting the front walls at their bottom end on the door sill of the car and at their top end on the support means of the door operator.

The different solutions and features presented above can be inventive features together with one or more other features of the invention.

It is obvious to the person skilled in the art that the invention is not limited solely to the examples described above, but that it may be varied within the scope of the claims presented below. Thus, for example, at least the corner elements of the floor of the elevator car can also be fabricated from aluminium, instead of from plastic material, by extruding in which case heat resistance improves.

It is also obvious to the person skilled in the art that the shape, size and number of the modular elements used in the floor and roof of the elevator car can differ to what is presented above. There can be 2, 3, 4, 6, 7, 8, 9 or even more parallel elements, instead of the five elements presented.

It is further obvious to the person skilled in the art that a so-called honeycomb structure, wherein the material of the honeycomb board is steel or aluminium, can be used as the floor of the elevator car instead of, or in addition to, the modular plastic structure. The same structure can also be used in the roof of the elevator car.

A person skilled in the art will also understand that the suspension of the elevator car can differ from that presented in the embodiments. A suspension member and/or traction member can be connected to the elevator car by means of one or more diverting pulleys, in which case the advantages provided by a higher suspension ratio are gained.

The invention claimed is:

1. An elevator car configured to be installed in an elevator, the elevator car comprising:

an elevator car floor including a set of coupled elevator car floor modular elements; and an elevator car roof including a set of coupled elevator car roof modular elements;

wherein the elevator car is configured to be supported in an elevator hoistway on at least one suspension member;

wherein the elevator car is configured to be moved through the elevator hoistway based on operation of a hoisting machine; and wherein at least one modular element of the set of coupled elevator car floor modular elements or the set of coupled elevator car roof modular elements is configured to be directly fixed to the at least one suspension member to directly support the elevator car in the elevator hoistway, such that the elevator car is supported, by the at least one suspension member, directly through the at least one modular element of the set of coupled elevator car floor modular elements or the set of coupled elevator car roof modular elements.

2. The elevator car according to claim 1, wherein, the at least one modular element is configured to couple with a traction member, and the traction member is configured to move the elevator car through the elevator hoistway.

3. The elevator car according to claim 1, wherein, each set of the set of coupled elevator car floor modular elements and the set of coupled elevator car roof modular elements includes a plurality of adjacent modular elements configured to interlock together.

4. The elevator car according to claim 1, wherein, the set of coupled elevator car floor modular elements include two corner elements, two intermediate elements and one center element, and the set of coupled elevator car floor modular elements are configured to be fixed together such that each corner element is fixed to a separate adjacent intermediate element of the two intermediate elements, the center element is fixed between the two intermediate elements, and adjacently fixed modular elements at least partially overlap each other.

5. The elevator car according to claim 1, wherein, the set of coupled elevator car roof modular elements include two corner elements, two intermediate elements and one center element, and the set of coupled elevator car roof modular elements are configured to be fixed together such that each corner element is fixed to a separate adjacent intermediate element of the two intermediate elements, the center element is fixed between the two intermediate elements, and adjacently fixed modular elements at least partially overlap each other.

6. The elevator car according to claim 1, wherein, each given set of modular elements, of the set of coupled elevator car floor modular elements and the set of coupled elevator car roof modular elements, includes two corner elements, a center element, and at least two intermediate elements, the intermediate elements in the given set of modular elements configured to be coupled between separate corner elements of the given set of modular elements and the center element of the given set of modular elements; and the elevator car is configured to be adjusted in width, based on adjustment of at least one of a quantity and a width of the center element and intermediate elements in each set of modular elements.

7. The elevator car according to claim 1, wherein the set of coupled elevator car floor modular elements and the set of coupled elevator car roof modular elements include at least one of a plastic compound and a plastic composite compound.

8. The elevator car according to claim 1, further comprising:

a plurality of fabricated wall panels, wherein the plurality of fabricated wall panels are fabricated into their respective shapes from at least one of a plastic compound and a plastic composite compound based on pressing.

9. The elevator car according to claim 8, wherein, each given wall panel includes a top edge and a bottom edge;

each of the top edge and the bottom edge includes a batten-shaped fixing edge, the batten-shaped fixing edge being thinner than a thickness of the given wall panel;

each of the elevator car floor and the elevator car roof includes separate, respective corner elements;

each corner element includes a slot corresponding to a batten-shaped fixing edge of at least one wall panel of the plurality of fabricated wall panels; and each batten-shaped fixing edge of each wall panel is configured to be fixed into a corresponding slot of at least one of the elevator car floor and the elevator car roof.

10. The elevator car according to claim 8, wherein each given wall panel includes sound-damping elements protruding from the given wall panel, and the sound-damping elements are pressed onto the given wall panel in conjunction with fabrication of the given wall panel.

11. The elevator car according to claim 1, wherein, the at least one modular element is configured to couple with at least one of a fixing device or a diverting pulley of the at least one suspension member and a moving device of the elevator car.

12. The elevator car according to claim 1, wherein at least one modular element of the elevator car roof and at least one modular element of the elevator car floor includes at least one fixing point configured to couple with a car sling to support-the elevator car in the elevator hoistway.

13. An elevator car configured to be installed in an elevator, the elevator car comprising:

an elevator car floor including a set of coupled elevator car floor modular elements; and an elevator car roof including a set of coupled elevator car roof modular elements;

wherein the elevator car is configured to be supported in an elevator hoistway on at least one suspension member;

wherein the elevator car is configured to be moved through the elevator hoistway based on operation of a hoisting machine; and wherein each set of the set of coupled elevator car floor modular elements and the set of coupled elevator car roof modular elements includes a plurality of adjacent modular elements configured to interlock together such that the interlocked adjacent modular elements overlap in a direction that is orthogonal to a longitudinal direction extending through the interlocked adjacent modular elements, and the interlocked adjacent modular elements have lower surfaces and upper surfaces that are coplanar at upper surface interfaces and lower surface interfaces between the interlocked adjacent modular elements, respectively, such that the interlocked adjacent modular elements form a structure that includes, on opposite surfaces of the structure, uniform surfaces that extend between the interlocked adjacent modular elements, respectively.

14. The elevator car of claim 13, wherein, at least one plurality of adjacent modular elements includes a first modular element and a second modular element that is adjacent to the first modular element, the first modular element includes a protrusion, the second modular element includes a recess that corresponds to the protrusion of the first modular element, and the first and second modular elements are configured to interlock together such that the protrusion of the first modular element is nested in the recess of the second modular element.

15. The elevator car of claim 14, wherein, the recess is a slot configured to enclose the protrusion of the first modular element in the direction that is orthogonal to the longitudinal direction when the first and second modular elements are interlocked together.

16. An elevator car configured to be installed in an elevator, the elevator car comprising:

an elevator car floor including a set of coupled elevator car floor modular elements; and an elevator car roof including a set of coupled elevator car roof modular elements;

wherein the elevator car is configured to be supported in an elevator hoistway on at least one suspension member;

wherein the elevator car is configured to be moved through the elevator hoistway based on operation of a hoisting machine; and wherein one or more sets of modular elements, of the set of coupled elevator car floor modular elements and the set of coupled elevator car roof modular elements, includes a plurality of modular elements that consists of two corner elements, two intermediate elements, and one center element, wherein the plurality of modular elements are configured to be fixed to each other at respective adjacent overlapping sides that overlap in a direction that is orthogonal to a longitudinal direction extending through the plurality of modular elements, such that each corner element of the plurality of modular elements is adjacent and fixed to a separate intermediate element of the plurality of modular elements, and the one center element of the plurality of modular elements is adjacent and fixed to each of the intermediate elements of the plurality of modular elements.

17. The elevator car according to claim 16, further comprising:

a plurality of fabricated wall panels, wherein the plurality of fabricated wall panels are fabricated into their respective shapes from at least one of a plastic compound and a plastic composite compound based on pressing.

18. The elevator car according to claim 17, wherein, each given wall panel includes a top edge and a bottom edge;

each of the top edge and the bottom edge includes a batten-shaped fixing edge, the batten-shaped fixing edge being thinner than a thickness of the given wall panel;

each of the elevator car floor and the elevator car roof includes separate, respective corner elements;

each corner element includes a slot corresponding to a batten-shaped fixing edge of at least one wall panel of the plurality of fabricated wall panels; and each batten-shaped fixing edge of each wall panel is configured to be fixed into a corresponding slot of at least one of the elevator car floor and the elevator car roof.

19. The elevator car according to claim 17, wherein each given wall panel includes sound-damping elements protruding from the given wall panel, and the sound-damping elements are pressed onto the given wall panel in conjunction with fabrication of the given wall panel.

20. The elevator car according to claim 16, wherein, at least one modular element, of the set of coupled elevator car floor modular elements and the set of coupled elevator car roof modular elements, is configured to couple with at least one of a fixing device or a diverting pulley of the at least one suspension member and a moving device of the elevator car.

* * * * *